United States Patent [19]

Yee

[11] 4,074,549

[45] Feb. 21, 1978

[54] LOCK MECHANISM

[75] Inventor: Li Sze Yee, Kowloon, Hong Kong

[73] Assignee: Kwoon Kwen Metal Ware Company Limited, Kowloon, Hong Kong

[21] Appl. No.: 719,993

[22] Filed: Sept. 2, 1976

[30] Foreign Application Priority Data

Sept. 26, 1975 United Kingdom ..... 39540/75

[51] Int. Cl.[2] ..... E05B 65/48

[52] U.S. Cl. ..... 70/7; 70/75; 292/247

[58] Field of Search ..... 70/2, 3, 4, 5, 6, 7, 70/8, 9, 10, 11, 12, 13, 69, 70, 71, 72, 73, 74, 75, 76; 292/113, 114, 246, 247, 248, 249, 250; 49/34; 160/328

[56] References Cited

U.S. PATENT DOCUMENTS

| | | | |
|---|---|---|---|
| 2,300,508 | 11/1942 | Komenek | 70/76 |
| 3,030,137 | 4/1962 | Cheney | 292/113 |
| 3,321,230 | 5/1967 | Stollman | 292/247 X |
| 3,584,906 | 6/1971 | Budzyn | 292/247 |

*Primary Examiner*—Robert L. Wolfe

*Attorney, Agent, or Firm*—McCormick, Paulding & Huber

[57] ABSTRACT

A lock mechanism comprising a mounting part, a manually operable part, a retaining part and a stabilizer part, said parts being pivotally connected together as a substantially parallelogram linkage with the retaining part and mounting part located on opposed sides of such linkage; the manually operable part, retaining part and stabilizer part of the linkage being pivotable relative to the mounting part between a locking condition, in which the retaining part is intended to engage a component which is to be secured by the mechanism and further in which the operable part is substantially parallel with and lies adjacent to the mounting part, and a release condition, in which the retaining part is intended to be disengaged from said securable component; pivotal movement of the linkage between its locking and release conditions being effected by manual displacement of the operable part relative to the mounting part. A lock device is provided on one of said parts to be optionally engageable with a further of said parts by which pivotal movement of the linkage can be prevented when the mechanism is in its locking condition.

12 Claims, 5 Drawing Figures

LOCK MECHANISM

This invention relates to lock mechanisms and is particularly concerned with such a mechanism of the type which may be used, for example, on suitcases, briefcases and similar hand luggage.

According to the present invention there is provided a lock mechanism comprising a mounting part, a manually operable part, a retaining part and a stabiliser part, said parts being pivotally connected together as a substantially parallelogram linkage with the retaining part and mounting part located on opposed sides of such linkage; the manually operable part, retaining part and stabiliser part of the linkage being pivotable relative to the mounting part between a locking condition, in which the retaining part is intended to engage a component which is to be secured by the mechanism and further in which the operable part is substantially parallel with and lies adjacent to the mounting part, and a release condition in which the retaining part is intended to be dis-engaged from said securable component; pivotal movement of the linkage between its locking and release conditions being effected by manual displacement of the operable part relative to the mounting part; and wherein a lock device is provided on one of said parts to be optionally engageable with a further of said parts by which pivotal movement of the linkage can be prevented when the mechanism is in its locking condition.

Further according to the present invention there is provided a lock assembly which comprises a lock mechanism as specified in the immediately preceding paragraph and a securable component with which the retaining part is intended to engage and secure when the mechanism is in its locking condition.

The lock mechanism and lock assembly comprising such mechanism of the present invention was particularly developed for securing a hinged lid of an article of hand luggage such as a suitcase, and while it will readily be appreciated that the mechanism may be utilised in other locking applications, for convenience the invention will hereinafter be considered in its application to the securing of a hinged suitcase lid. The mounting part will generally be in the form of a plate which is mounted by rivets or bolts on the container part of the suitcase, while the securable component is similarly mounted to the suitcase lid so that when the lid is closed the securable component and retaining part are in side-by-side relationship. These latter two parts are moved into side-by-side relationship while the lock mechanism is in its release condition and thereafter the manually operable part is pivoted to displace the linkage into its locking condition, in which the retaining part engages with the securable part to prevent the lid being opened. When in its locking condition the lock device (which will usually be key operated) of the mechanism can be operated to secure one of the parts to at least one other of the parts.

The engagement of the retaining part with the securable component is conveniently achieved by the retaining part moving over and capturing an upstanding projection of the securable part as the linkage moves towards its locking condition. Having this latter arrangement in mind, it is preferred that the retaining part comprises a substantially "U" shaped plate between the legs of which is located the manually operable part which is pivotally connected to the retaining part and so disposed that an aperture is formed between the operable part and the base portion of the "U" shaped retaining part and it is within this aperture that the securable component is captured.

Preferably the release condition of the lock mechanism is attained when the operable part is substantially perpendicular to the mounting part and stops may be provided which are intended to prevent excess pivotal movement of the operable part beyond the predetermined release condition.

It is also preferred that the linkage of the mechanism is spring-loaded to bias the mechanism towards its locking condition and also towards its release condition from an intermediate neutral position of the linkage between said conditions, at which intermediate neutral position the spring-biasing is ineffective. Conveniently the spring-biasing is achieved by spring means carried on the mounting part which act directly on the manually operable part so that on pivotal movement of the linkage from one of its locking condition and release condition, the operable part reacts against the spring means until the linkage is in its neutral position when the spring means is in a top dead centre condition, and wherein upon continued pivotal movement of the operable part, the spring means biasses the linkage towards the other of its locking and release conditions.

The lock device may be carried by a suitable one of the aforementioned parts for engagement with one or more of the other parts, but conveniently it is carried by the manually operable part for optional securement to the mounting part to prevent pivotal movement between said parts when the linkage is in its locking condition.

One embodiment of a lock assembly comprising a lock mechanism and securable component constructed in accordance with the present invention will now be described by way of example only with reference to the accompanying illustrative drawings in which.

Figure 1:
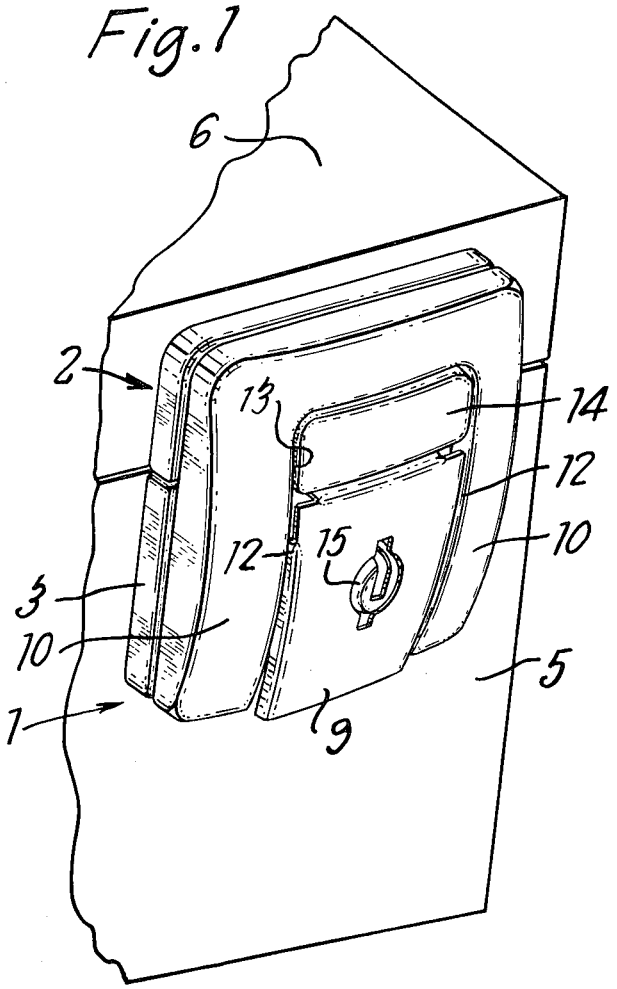
FIG. 1 is a perspective view of the lock assembly mounted on a suitcase and in its locking condition.

The lock assembly comprises a lock mechanism 1 and a securable component 2. The mechanism 1 has a mounting plate 3 with holes 4 through which the mechanism is secured by rivets to a container part 5 of a suitcase as shown in FIG. 1. The suitcase has a hinged lid 6 to the flange of which is affixed the securable component 2 by rivets extending through holes 7 in that component so that when the lid 6 is closed the component 2 lies adjacent to the mounting plate 3. To assist in maintaining alignment between the component 2 and mounting plate 3 the latter is provided with small tapered studs 8 which are received within substantially complementary recesses in the component 2 when the lid 6 is closed.

The mounting plate 3 forms one side of a parallelogram linkage, the other three sides of which are formed by a manually operable plate 9, a retaining plate 10 which substantially overlies the plate 3 and a stabiliser link 11 (see FIG. 2), the sides of the linkage being pivotally connected at 12. The parallelogram linkage is arranged so that the retaining plate 10 and mounting plate 3 form opposed sides thereof. The retaining plate 10 is of substantially "U" shape (see FIG. 3) and the operable plate 9 is located between the legs of the "U" shaped plate to which it is pivotally connected at 12 at a position remote from the ends of the legs. The stabiliser link 11 is in the form of a "U" shaped rod the free ends of the legs of which are pivoted at 12 to the mounting plate 3 while the cross bar of the "U" shaped rod 11 extends between, and is pivoted to, the legs of the retaining plate 10 at the free ends thereof.

Figure 2:
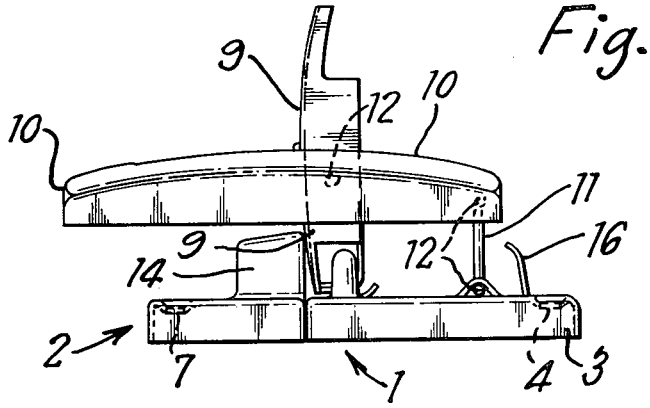
FIG. 2 is a side elevation of the assembly incorporated in FIG. 1 and with the mechanism in its release condition.
Figure 3:
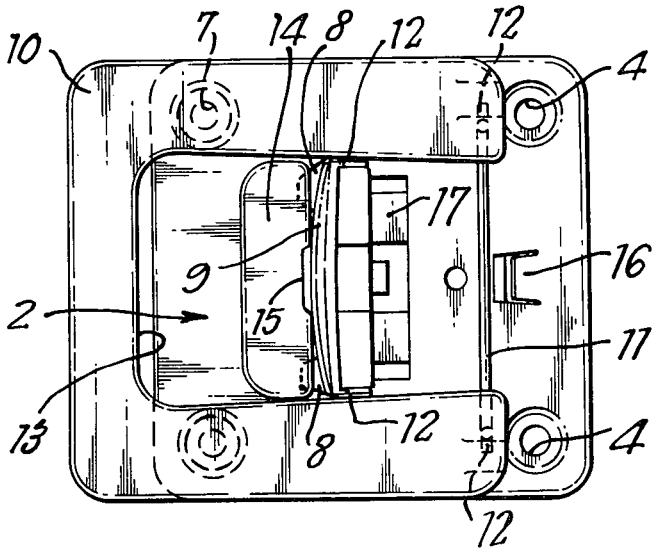
FIG. 3 is a plan view of the assembly shown in FIG. 2 with the securable component displaced from the lock mechanism.
Figure 4:
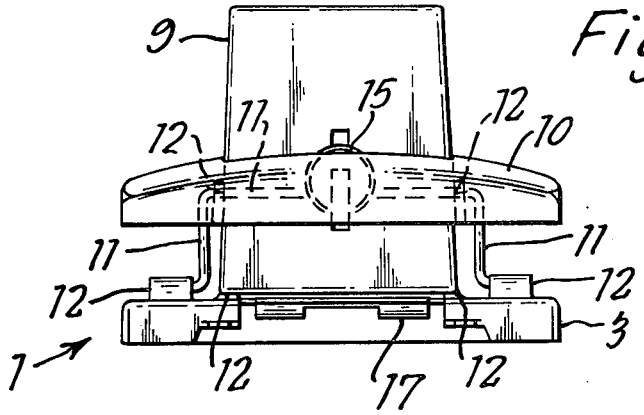
FIG. 4 is an end view of the lock mechanism shown in FIG. 2 (the securable component having been removed)

By the linkage arrangement as above described it will be seen from FIG. 2 that the parallelogram arrangement permits the operable part 9 to be moved manually clockwise relative to the plate 3 while the stabiliser link 11 moves in sympathy therewith until the retaining plate 10 abuts against the mounting plate 3 when the links 3 and 9 to 11 are substantially parallel.

With the plates 3 and 10 in abutment as aforementioned the lock mechanism is regarded as being in a locking condition as compared with the release condition for the mechanism substantially as shown in FIG. 2 where the operable plate 9 is generally perpendicular to the plate 3. Desirably the operable plate 9 has associated therewith stops (not shown) which prevent that plate from being pivoted anti-clockwise relative to the plate 3 in FIG. 2 beyond the predetermined release condition as aforementioned.

Figure 5:
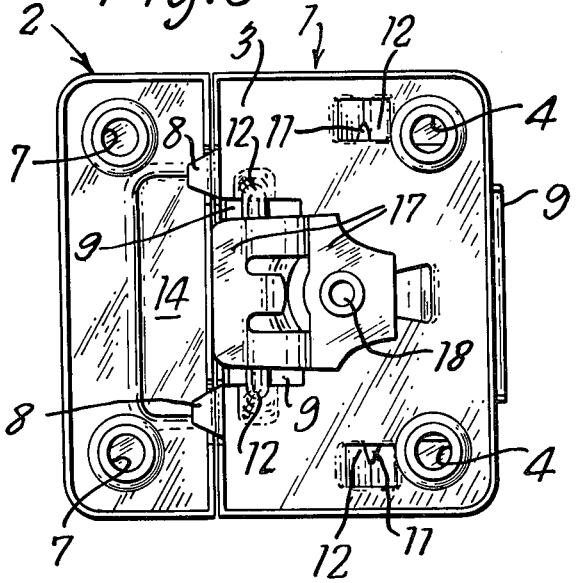
FIG. 5 is an inverted plan view of the lock assembly with the mechanism in its locking condition.

With the mechanism 1 in its locking condition the operable plate 9 has a length substantially equal to that of the plate 3 and substantially overlies the plate 3 although a small overlap is provided for the plate 9 as shown in FIG. 5 to facilitate manual engagement of the plate 9. In addition however, the retaining plate 10 extends for part of its length beyond the mounting plate 3 with the mechanism in its locking condition (as is best seen in FIG. 1) and it is this extended part of the retaining plate which engages the securable component 2. Such engagement is achieved by an aperture 13 (formed between the operable plate 9 and the base portion of the "U" shaped plate 10 adjacent to the cross bar thereof) receiving a substantially complementary projection 14 on the securable plate 2. By such an arrangement, as the mechanism 1 is adjusted from its release condition in FIG. 2 to its locking condition in FIG. 1 the retaining plate 10 is progressively lowered and displaced rightwardly in FIG. 2 so that the projection 14 is received and captured within the aperture 13 so preventing the lid 6 from being opened.

The operable plate 9 is formed as a casing housed within which is a key operated lock device 15. The purpose of the lock device 15 is to secure the operable plate 9 to the mounting plate 3 when the lock mechanism is in its locking condition, thereby preventing pivotal movement of the parallelogram linkage and release of the component 2. In the present example the lock device 15 comprises a disc rotatably mounted within the casing structure and adjustable by rotation of a key so that such disc selectively engages or disengages beneath a bracket 16 on the mounting plate 3 when the mechanism is in its locking condition. With the disc of the lock device 15 in engagement with the bracket 16 it will be apparent that the operable plate 9 is retained from pivotal movement relative to the plate 3.

To provide a degree of feel during manual adjustment of the lock mechanism and also to ensure that the linkage is of a relatively stable configuration when in its locking or release conditions a leaf spring 17 is provided which serves to bias the linkage to either its release or locking conditions from an intermediate neutral position between these two conditions. The spring 17 is mounted on the underside of the plate 3 and secured thereto by a rivet 18 while the operative part of the spring engages against the end of the plate 9 which is pivotally connected to the plate 3. The aforementioned operative part of the spring 17 is appropriately shaped and arranged so that during clockwise movement of the plate 9 from its position shown in FIG. 2 the plate 9 slides over the spring which provides a spring bias to resist such movement until a neutral spring position is reached (for example when the plate 9 is povited to 45° relative to the plate 3) corresponding to a top dead centre condition for the spring after which continued pivotal movement of the plate 9 clockwise in FIG. 2 is assisted by the biassing of spring 17 so that the mechanism effectively snaps into its locking condition. In moving the operable plate 9 from the locking condition to the release condition a reverse effect is achieved whereby the pivotal movement is initially opposed by the spring-biassing and the final pivotal movement is assisted by the spring-biassing so that the mechanism effectively snaps into its release condition.

What I claim is:

1. A lock mechanism comprising a mounting part, a manually operable part, a retaining part and a stabiliser part, said parts being pivotally connected together as a substantially parallelogram linkage with the retaining part and mounting part located on opposed sides of such linkage; the manually operable part, retaining part and stabiliser part of the linkage being pivotable relative to the mounting part between a locking condition, in which the retaining part is intended to engage a component which is to be secured by the mechanism and further in which the operable part is substantially parallel with and lies adjacent to the mounting part, and a release condition in which the retaining part is intended to be dis-engaged from said securable component; pivotal movement of the linkage between its locking and release conditions being effected by manual displacement of the operable part relative to the mounting part; and wherein a lock device is provided on one of said parts to be optionally engageable with a further of said parts by which pivotal movement of the linkage can be prevented when the mechanism is in its locking condition.

2. A lock mechanism as claimed in claim 1 in which the retaining part comprises a substantially U-shaped plate having a base portion and a pair of legs between which legs is located the manually operable part, the parts being so disposed that an aperture is formed between the manually operable part and the base portion of the U-shaped retaining part, within which aperture the securable component is intended to be captured when the linkage is in its locking condition.

3. A lock mechanism as claimed in claim 2 in which the manually operable part is pivotally connected to the retaining part at a position remote from the ends of the legs of the latter and wherein the pivotal connection of the stabiliser part to the retaining part is substantially at the free ends of the legs of the latter.

4. A lock mechanism as claimed in claim 3 in which the stabiliser part comprises a substantially U-shaped rod, the free ends of the legs of which are pivotally connected to the mounting plate while the cross bar thereof extends between, and is pivotally connected to the legs of the retaining part.

5. A lock mechanism as claimed in claim 1 in which the linkage has a neutral position between its locking condition and its release condition, and wherein the linkage is biassed firstly to the locking condition on pivotal movement of the linkage from the neutral position towards the locking condition, and secondly to the release condition on pivotal movement of the linkage from the neutral position towards the release condition, and further wherein the biassing is ineffective when the linkage is at its neutral position.

6. A lock mechanism as claimed in claim 5 in which the biassing of the linkage is achieved by spring means carried on the mounting part which act directly on the manually operable part so that on pivotal movement of the linkage from one of the locking and release conditions, the manually operable part reacts against the spring means until the operable part is in its neutral position when the spring means is in a top dead centre condition, and wherein upon continued pivotal movement of the operable part, the spring means biasses the linkage towards the other of its locking and release conditions.

7. A lock mechanism as claimed in claim 6 in which the spring means comprise a leaf spring.

8. A lock mechanism as claimed in claim 1 in which, in the release condition of the linkage, the manually operable part is substantially perpendicular to the mounting part and wherein the manually operable part has stop means associated therewith to restrain pivotal movement of the mounting part beyond the release condition.

9. A lock mechanism as claimed in claim 1 in which the lock device is carried by the manually operable part for optional securement to the mounting part to prevent pivotal movement between the two said parts when the linkage is in its locking condition.

10. A lock mechanism as claimed in claim 9 in which the lock device is key operated and wherein the manually operable part is formed as a casing within which is housed the lock device, the lock device serving to secure the manually operable part to the mounting part when the lock mechanism is in its locking condition thereby preventing pivotal movement of the linkage.

11. A lock assembly comprising a lock mechanism as claimed in claim 1 and a securable component with which the retaining part is intended to engage and secure when the mechanism is in its locking condition.

12. An article of hand luggage when having a lock assembly as claimed in claim 11 attached thereto.

* * * * *